US006321668B1

(12) United States Patent
Chen

(10) Patent No.: US 6,321,668 B1
(45) Date of Patent: Nov. 27, 2001

(54) BUTTON TRANSMISSION DEVICE FOR A BUTTON-SEWING MACHINE

(75) Inventor: Chin-Hsiung Chen, Taipei (TW)

(73) Assignee: Nissan Precission Machinery Co., Ltd., Taipei (TW)

( * ) Notice: Subject to any disclaimer, the term of this patent is extended or adjusted under 35 U.S.C. 154(b) by 0 days.

(21) Appl. No.: 09/694,827

(22) Filed: Oct. 24, 2000

(51) Int. Cl.[7] ..... D05B 3/22
(52) U.S. Cl. ..... 112/113
(58) Field of Search ..... 112/113, 110, 112/106, 108, 475.15

(56) References Cited

U.S. PATENT DOCUMENTS 4,690,077 * 9/1987 Nirenberg ..... 112/113
5,062,373 * 11/1991 Kichizo et al. ..... 112/113

* cited by examiner

*Primary Examiner*—Peter Nerbun
(74) *Attorney, Agent, or Firm*—A & J

(57) ABSTRACT

A button transmission device for a button-sewing machine generally includes a conveying device including two elongated sliding plates, a seat arranged between the two sliding plates, and a conveyor belt mounted on the seat, a positioner disposed above the seat, a puller arranged on one of the sliding plates and located against the positioner, a thickness adjuster arranged above the conveying device, and a positioning device provided with a stopper drivingly connected with a pneumatic cylinder, and a strip member mounted on an intermediate portion of the conveyor belt and having two sides higher than the conveyor belt to reduce friction between a button and the conveyor belt, whereby the transmission device can effectively sieve out defective buttons and transmit buttons with different specifications.

1 Claim, 15 Drawing Sheets

BUTTON TRANSMISSION DEVICE FOR A BUTTON-SEWING MACHINE

BACKGROUND OF THE INVENTION

1. Field of the Invention

This invention is related to an improvement in the structure of a button transmission device for a button-sewing machine.

2. Description of the Prior Art

It has been found that the button-sewing machine generally utilizes a button transmission device to sieve out defective buttons. As shown in FIG. 16, the conventional button transmission device is simply a square tubular member 30 arranged between the oscillator 10 and the button-sewing machine 20 for preventing the passage of larger buttons (the smaller button is sieved out by the oscillator 10). However, the square tubular member 30 is designed for the passage of a certain kind of button, and so the square tubular member 30 must be replaced with another one for a different kind of button thereby causing much inconvenience in use. Hence, it has been proposed to use an adjusting device 40 (see FIG. 17) to sieve out defective buttons, but it is still necessary to replace the square tubular member 30 with another one for a different kind of button when a different kind of button is to be sewed, thus still making it unfit for practical use.

Therefore, it is an object of the present invention to provide an improvement in the structure of a button transmission for a button-sewing machine which can obviate and mitigate the above-mentioned drawbacks.

SUMMARY OF THE INVENTION

This invention is related to an improvement in the structure of a button transmission device for a button-sewing machine.

According to a preferred embodiment of the present invention, a button transmission device for a button-sewing machine generally includes a conveying device including two elongated sliding plates, a seat arranged between the two sliding plates, and a conveyor belt mounted on the seat, a positioner disposed above the seat, a puller arranged on one of the sliding plates and located against the positioner, a thickness adjuster arranged above the conveying device, and a positioning device provided with a stopper drivingly connected with a pneumatic cylinder, and a strip member mounted on an intermediate portion of the conveyor belt and having two sides higher than the conveyor belt to reduce friction between button and the conveyor belt.

It is the primary object of the present invention to provide an improved button transmission device for a button-sewing machine which can effectively sieve out defective buttons.

It is another object of the present invention to provide an improved button transmission device for a button-sewing machine which can be used for transmitting buttons with different specifications.

It is a further object of the present invention to provide an improved button transmission device for a button-sewing machine which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
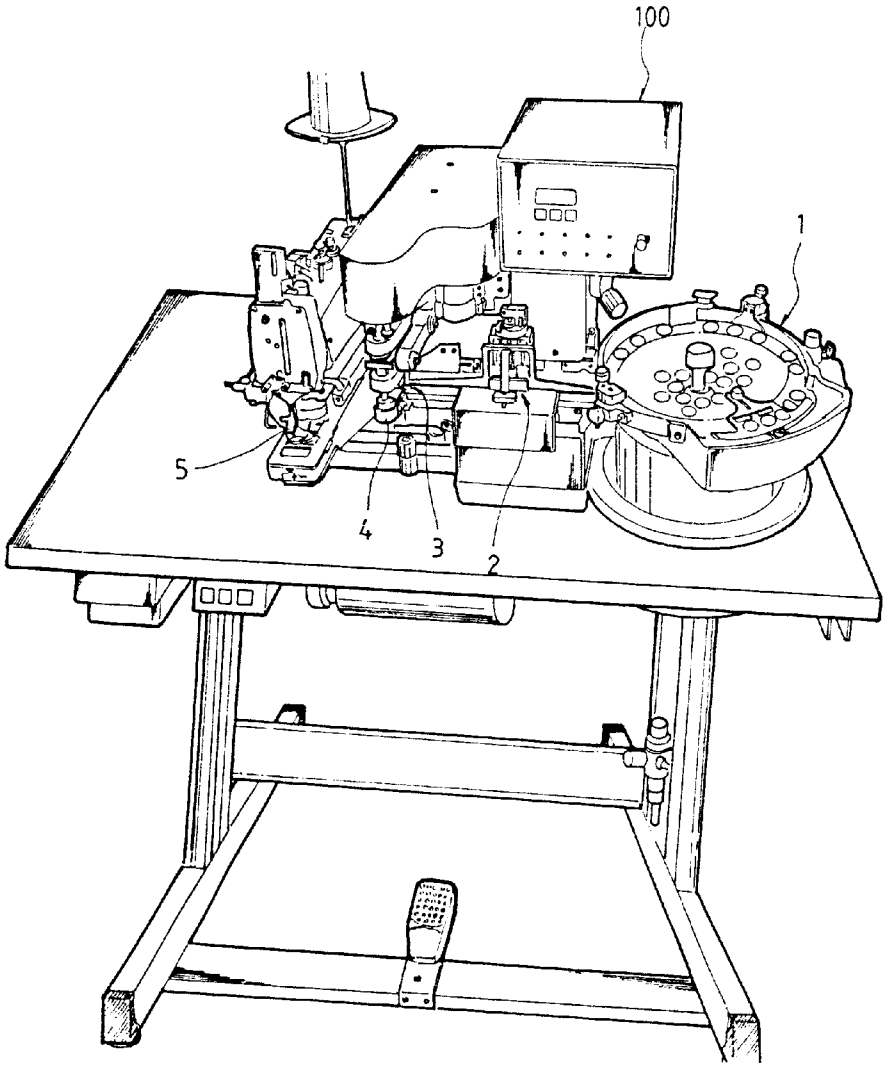
FIG. 1 illustrates the relationship between a button-sewing machine and a button transmission device according to the present invention.
Figure 2:
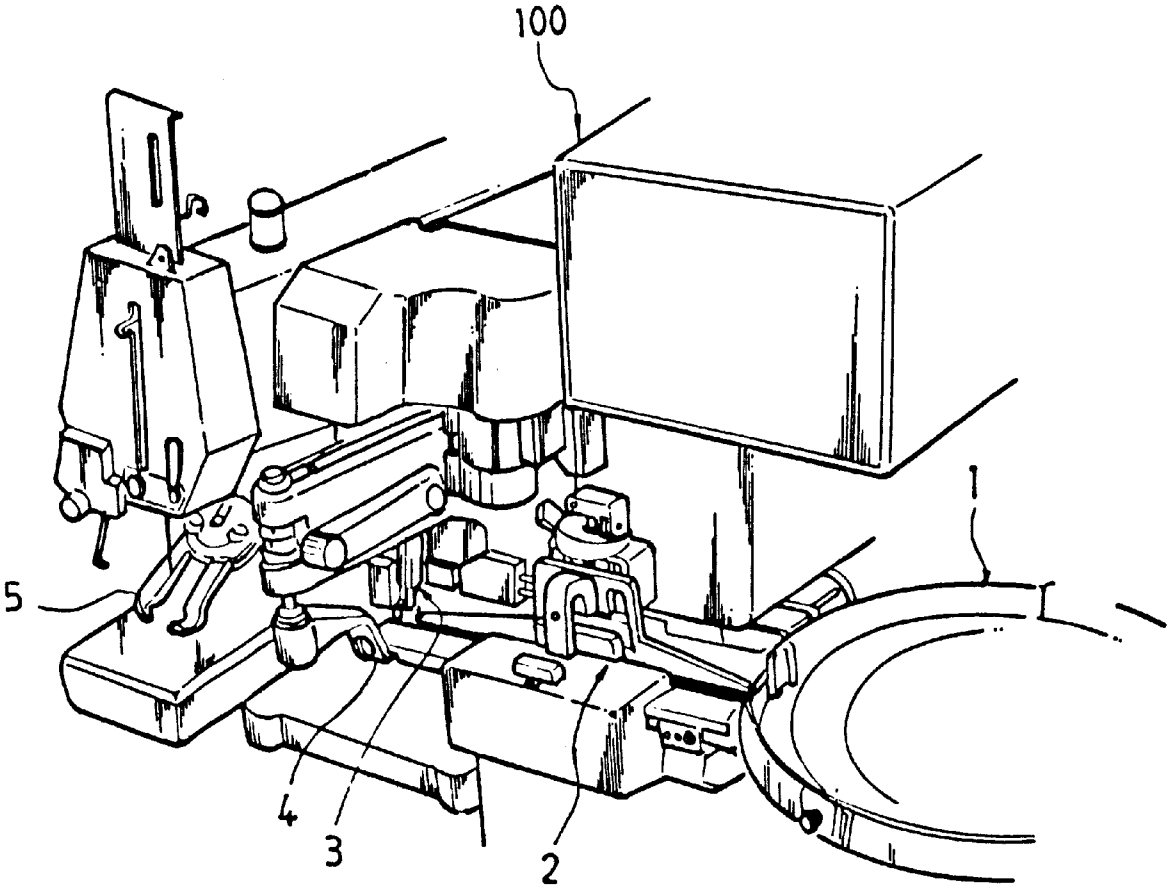
FIG. 2 is an enlarged fragmentary view of FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
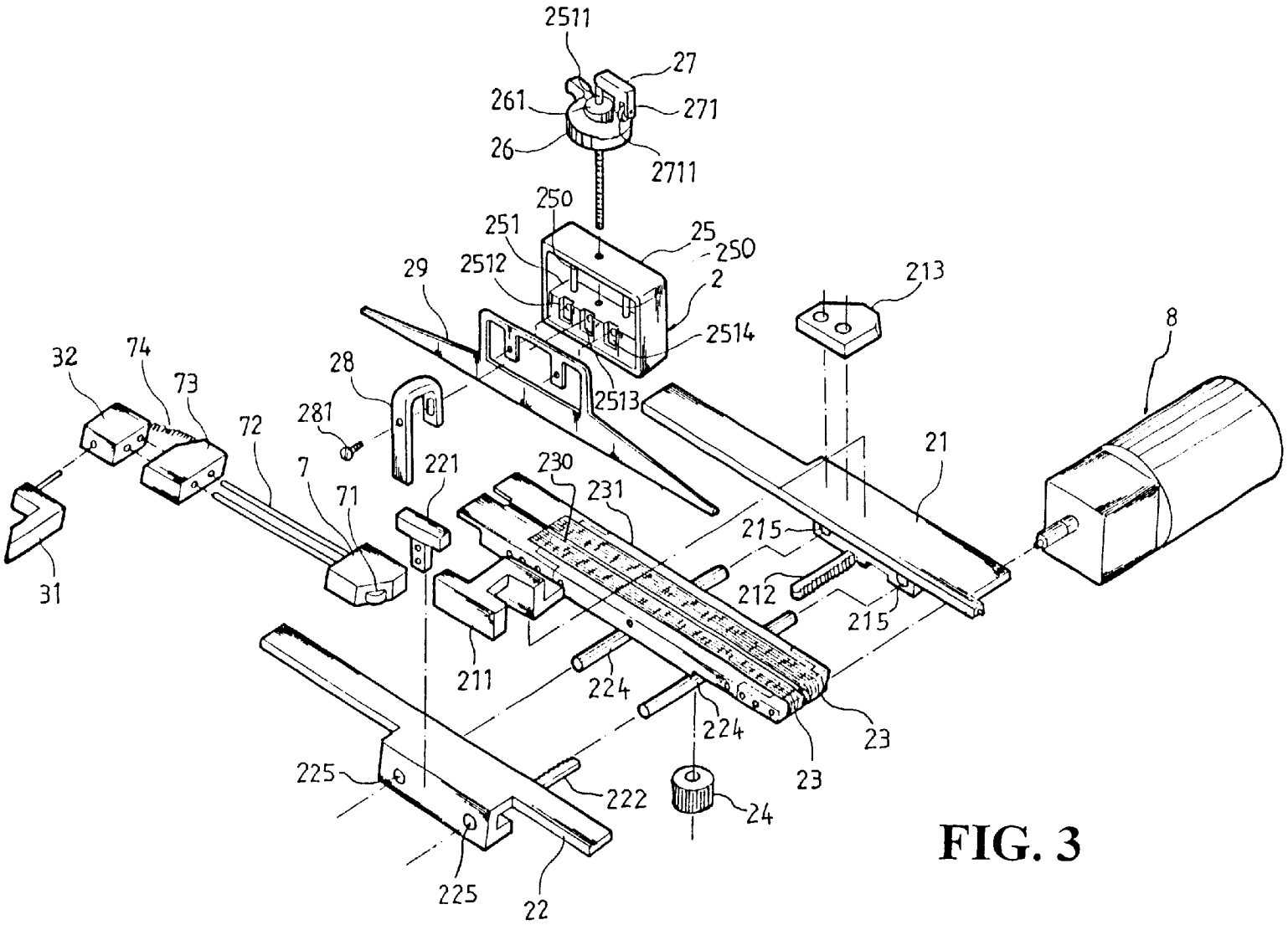
FIG. 3 is an exploded view of the present invention.
Figure 4:
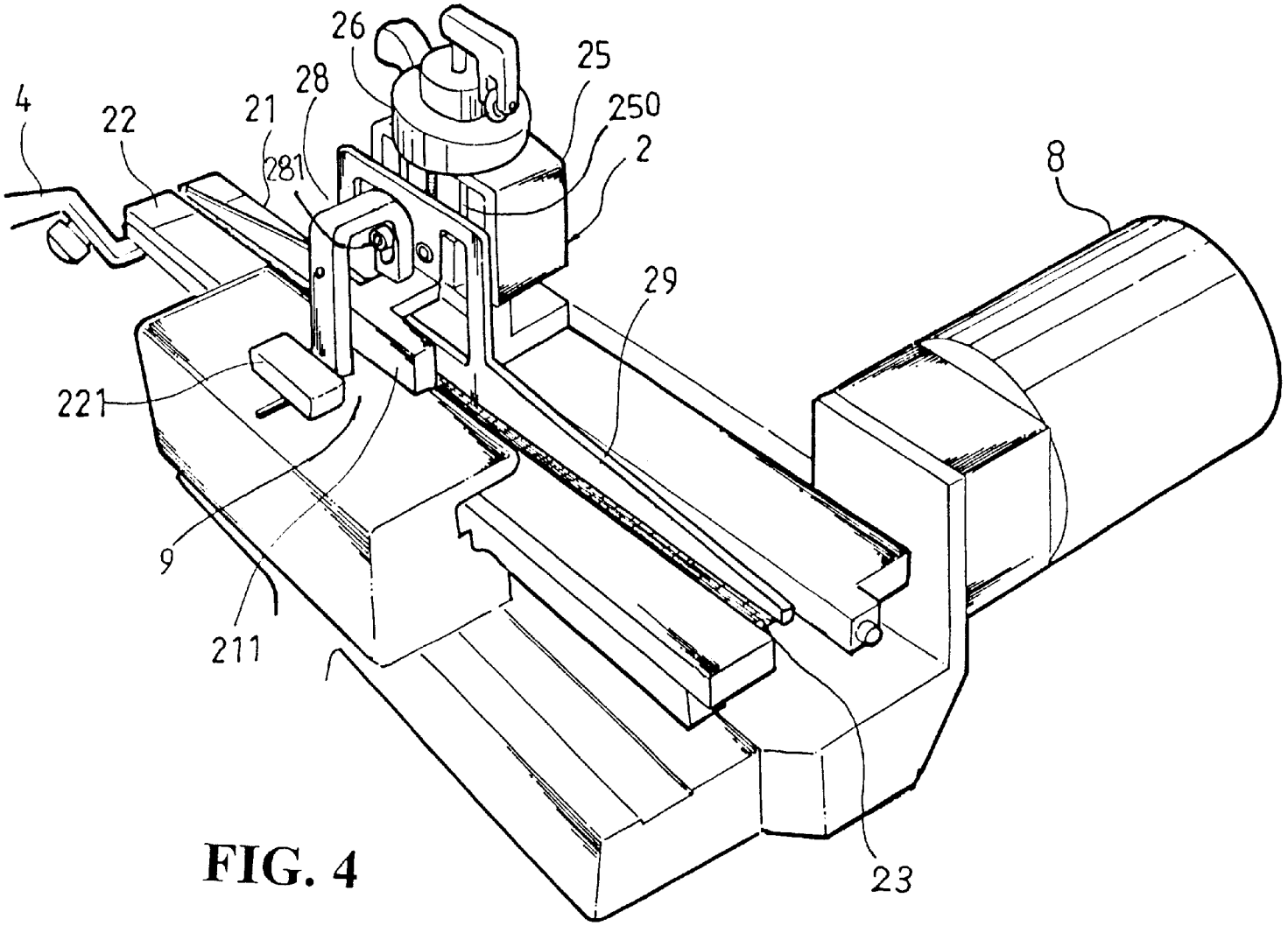
FIG. 4 illustrates how buttons are transmitted by the conveying device.
Figure 5:
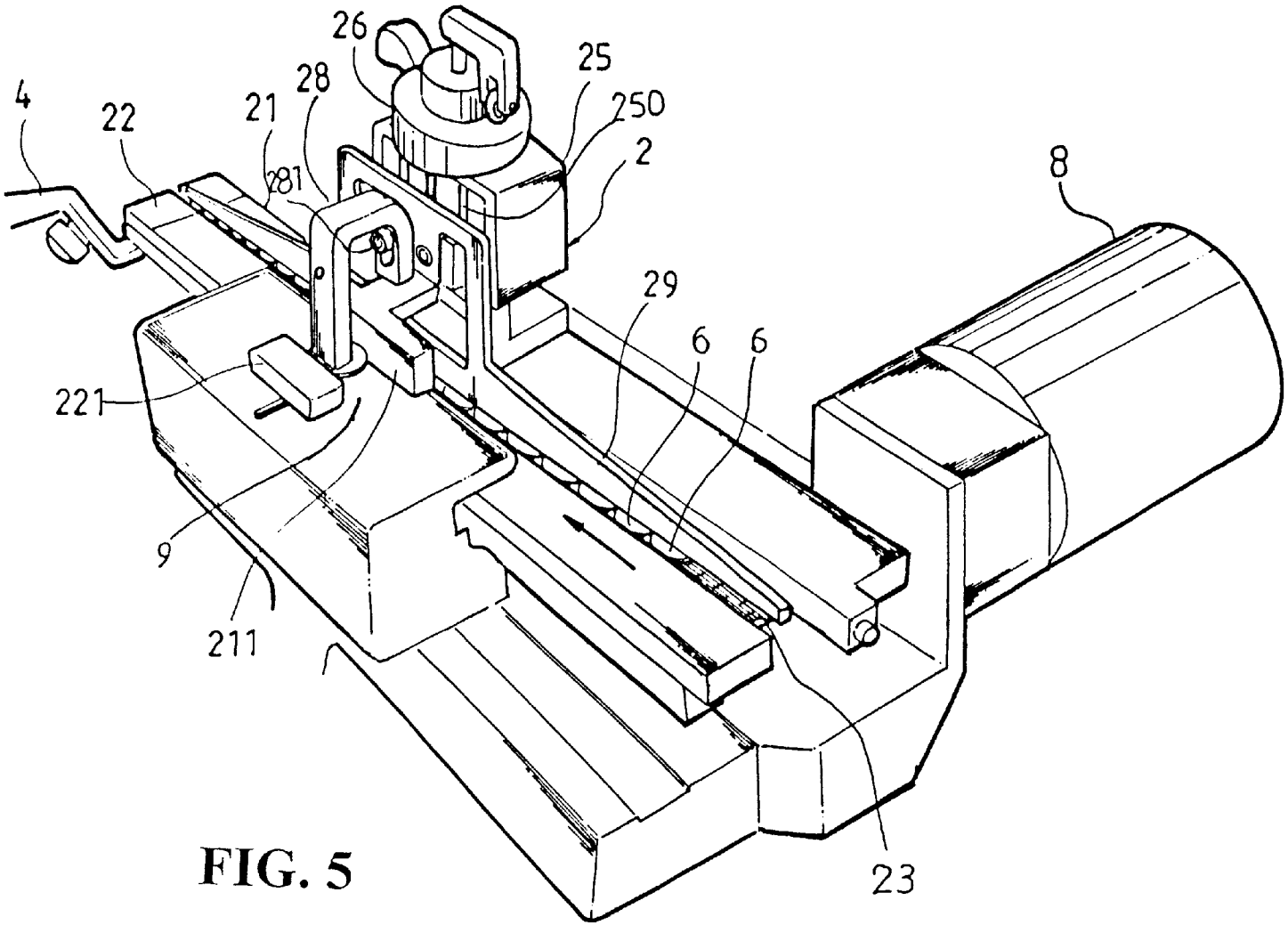
FIG. 5 is a perspective view of the conveying device.
Figure 6A:
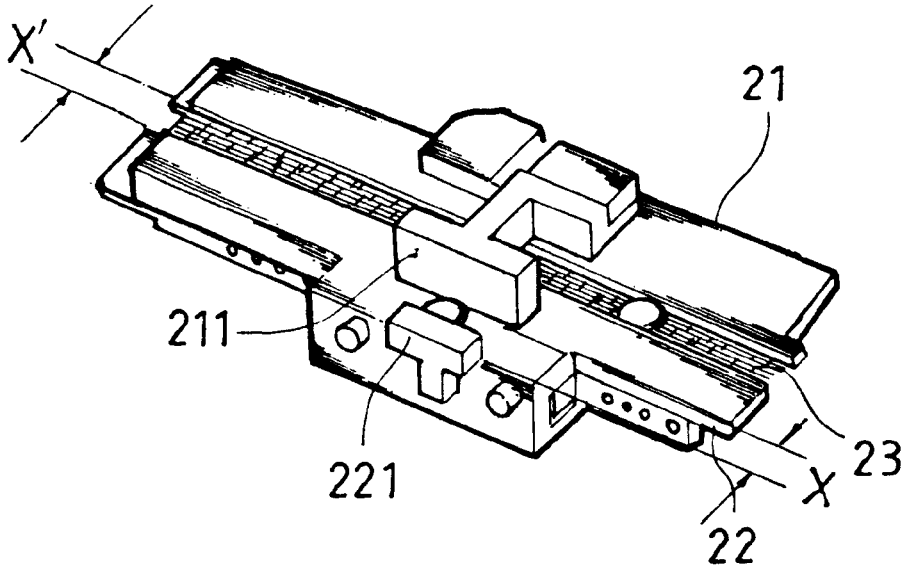
FIGS. 6A, 6B, 7A and 7B illustrate the working principle of adjusting the width of the passage for the button.
Figure 6B:
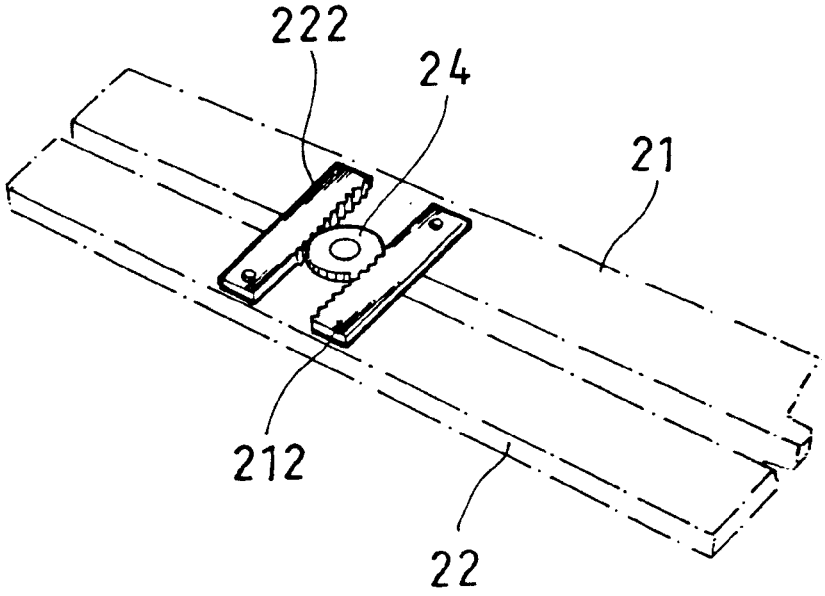
Figure 7A:
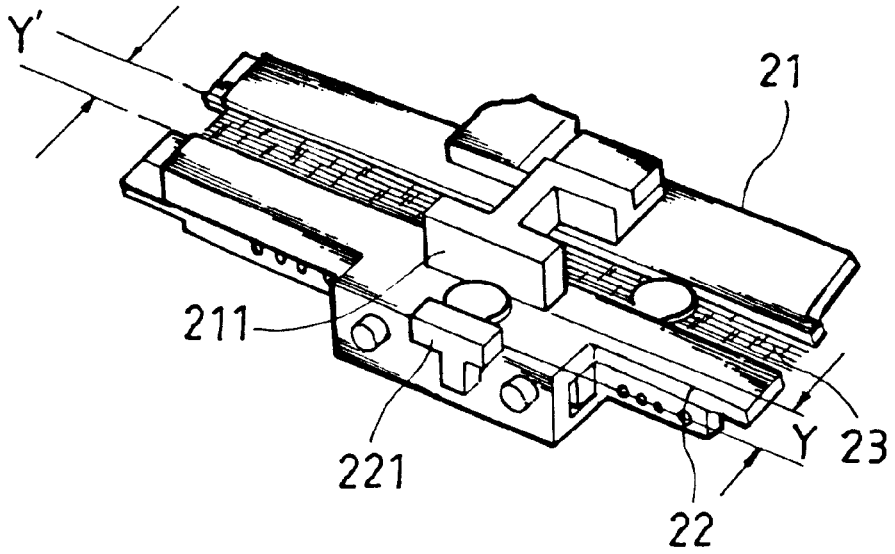
Figure 7B:
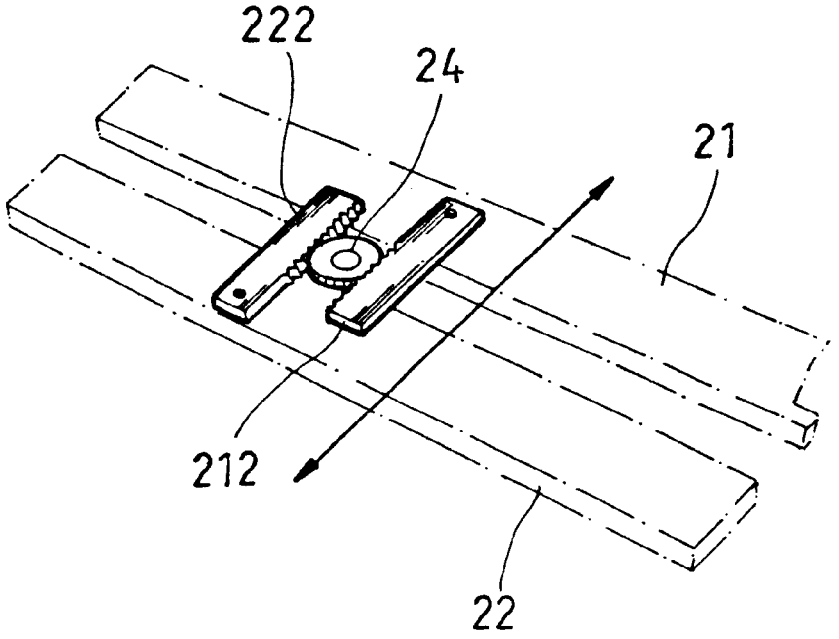

With reference to the drawings and in particular to FIGS. 3 and 4 thereof, the button transmission device for a button-sewing machine according to the present invention generally comprises an oscillator 1, a conveying device 2 and a positioning device 3 which are all mounted on a button-sewing machine 100. The button in the oscillator 1 is transmitted to an oscillating arm 4 through the conveying device 2. By means of a round rod 33 of the positioning device 3, the oscillating arm 4 rotates the button to a jig 5 for sewing to a garment.

Referring to FIGS. 3, 4, 6A, 6B, 7A and 7B, the conveying device 2 generally includes two elongated sliding plates 21 and 22, a seat 231 arranged between the two sliding plates 21 and 22, and a conveyor belt 23 mounted on the seat 231. A positioner 211 is disposed above the seat 231. A puller 221 is arranged on the sliding plate 22 and located against the positioner 211. The sliding plates 21 and 22 are provided at the bottom with two toothed racks 212 and 222 between which is engaged a gear 24. The sliding plates 21 and 22 are formed with holes 215 and 225 adapted to receive two rods 224 of the seat 231 so that when the puller 221 is moved to change the distance from the positioner 211, the distance between the two sliding plates 21 and 22 will be changed thereby adjusting the width of the conveyor belts 23.

Figure 8:
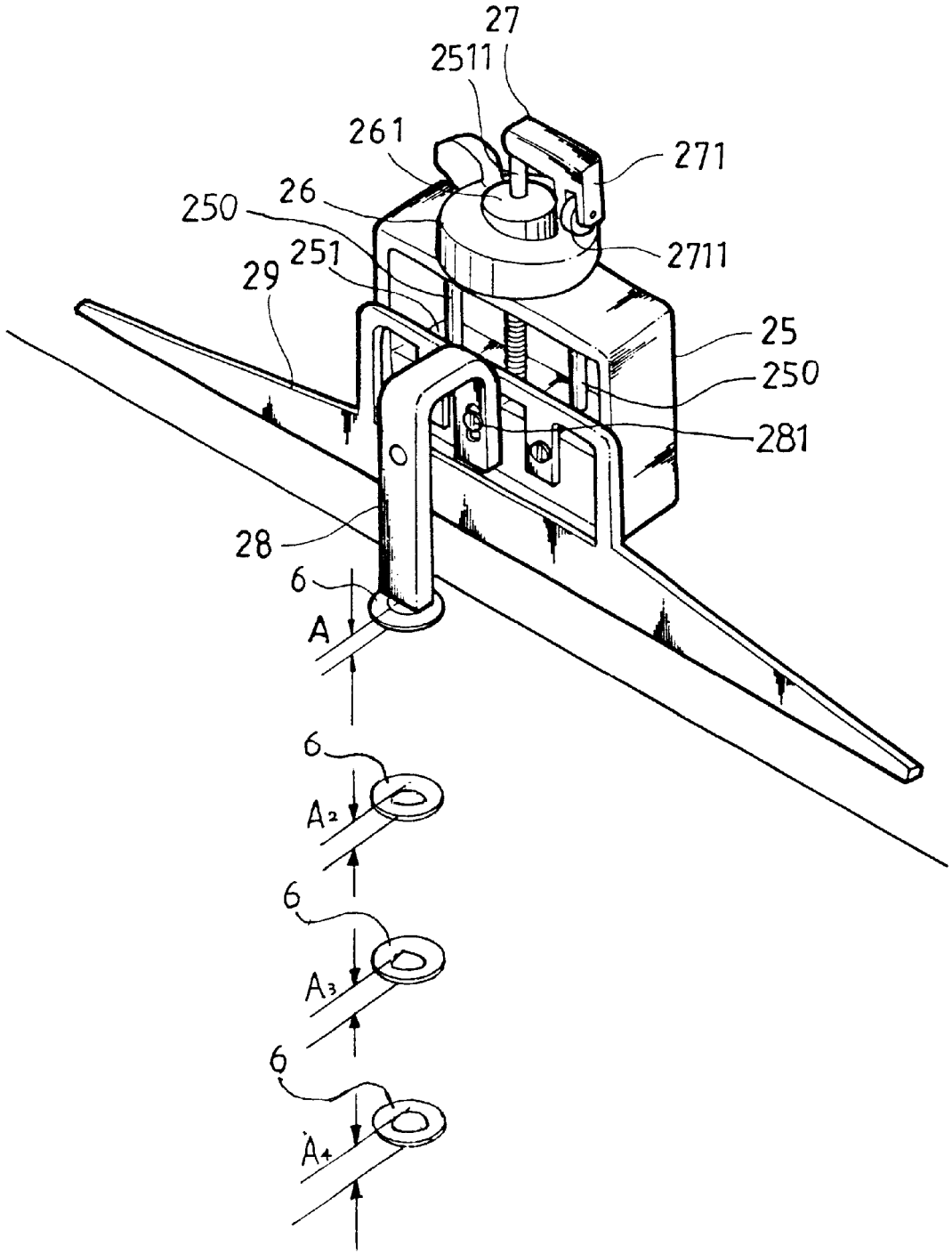
FIG. 8 is a schematic view of the thickness adjuster.

As shown in FIGS. 3, 4 and 8, a thickness adjuster is arranged above the conveying device 2. The thickness adjuster generally includes a case 25 in which is fitted a slide 251. The slide 251 is slidably mounted on two vertical guide rods 250. A screw rod 2511 extends vertically downwardly through the case 25 to engage with the intermediate portion of the slide 251 and extends vertically upwardly a circular disc 26 to pivotally connect with an L-shaped adjusting rod 27. The L-shaped adjusting rod 27 has a vertical portion 271 provided at the lower end with a roller 2711. A cylindrical portion 261 is integrally formed at the central portion of the circular disc 26 and has a center hole for the passage of the screw rod 2511. The circular disc 26 is formed with an inclined track so that when the circular disc 26 is rotated, the roller 2711 will move along the inclined track thereby moving the slide 251 to go upwardly or downwardly along the guide rods 250.

The slide 251 is formed with a first recess, 2512 at an end, a second recess 2514 at another end, and a third recess 2513 between the first and second recesses 2512 and 2514. The recess 2513 is engaged with a shorter leg of an inverted U-shaped member 28 (the inverted U-shaped member 28 has a shorter leg and a longer leg) by a screw 281 (see FIG. 8), while the other two recesses 2512 and 2514 are fixedly engaged with two lugs 291 of a limit member 29, so that the distance between the shorter leg of the inverted U-shaped member 28 and the conveyor belt 23 can be adjusted for the passage of a button with a particular thickness.

Referring to FIGS. 5, 8, 11 and 12, before the positioning operation of the passage for a button with a particular thickness, the bottom of the limit member 29 is in contact with a platform 9 and there is a clearance between the limit member 29 and the conveyor belt 23. The clearance can be adjusted as follows: rotating the circular disc 261 so that the roller 2711 will move upwardly along the inclined track of the circular disc 26 thereby lifting the slide 251 through the screw rod 2511 and therefore raising the limit member 29 and the inverted U-shaped member 28; loosening the screw 281; moving down the inverted U-shaped member 28 to make the lower end of the longer leg of the inverted U-shaped member contact the platform 9; locking the screw 281 (there is a small clearance between the limit member 29 and the conveyor belts 23 at that time); turning the circular disc 261 to lift the inverted U-shaped member 28; placing a button on the platform 9; and rotating the circular disc 261 to lower the longer leg of the inverted U-shaped member 28 on the button. The clearance A' between the limit member 29 and the conveyor belts 23 is slightly larger than the thickness A of the button thereby ensuring the smooth transmission of the button (see FIGS. 11 and 12).

Figure 9:
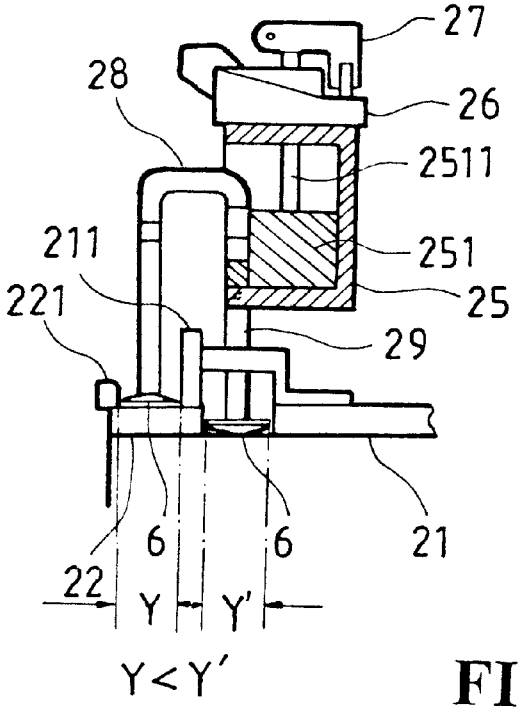
FIGS. 9 and 10 illustrate how to adjust the width of the passage for the button.
Figure 10:
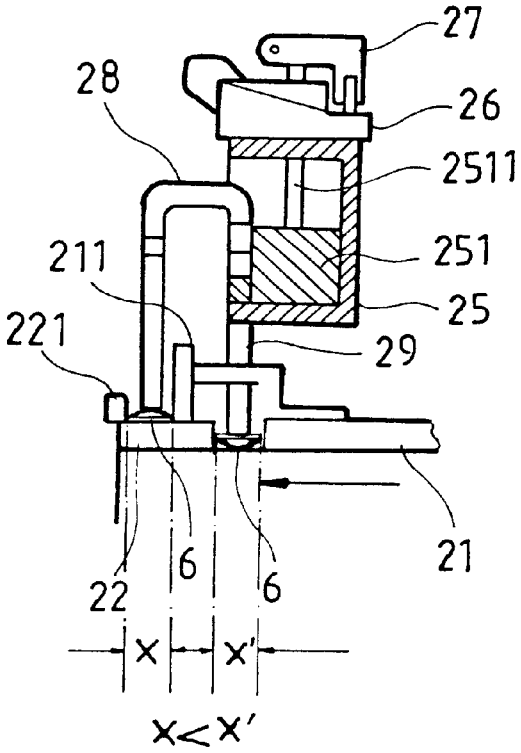
Figure 11:
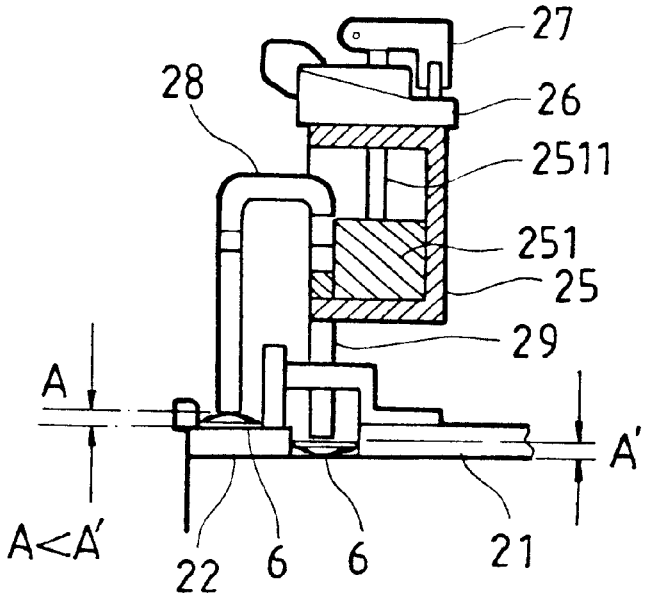
FIGS. 11 and 12 illustrate how to adjust the thickness of the passage for the button.
Figure 12:
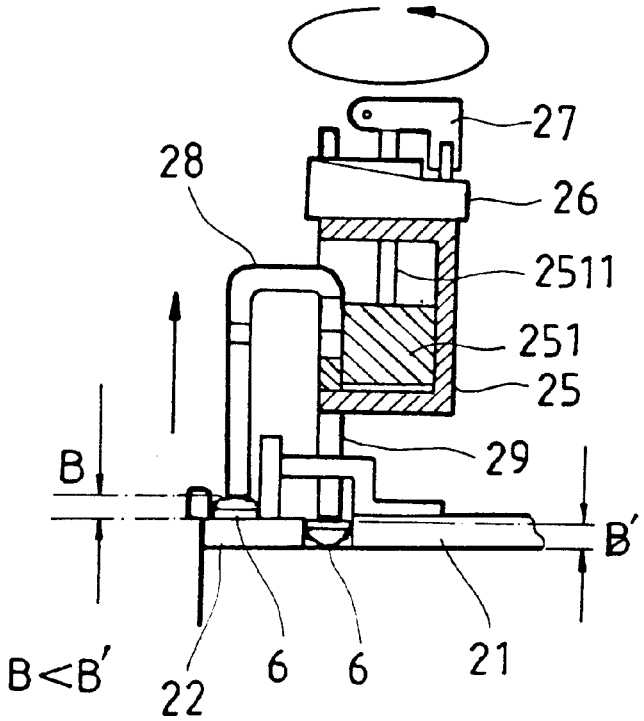
Figure 13:
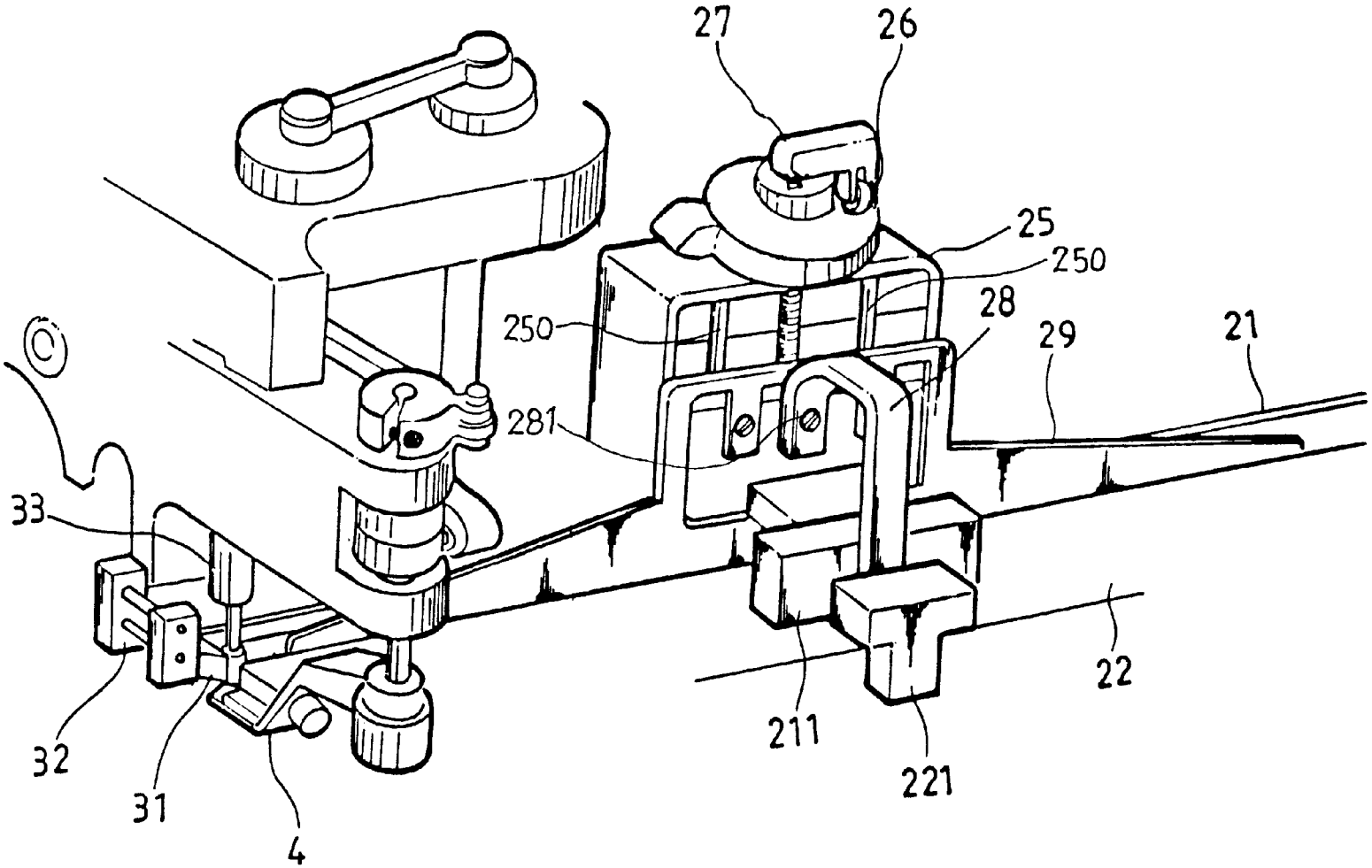
FIG. 13 illustrates the structure of the positioning device.
Figure 14A:
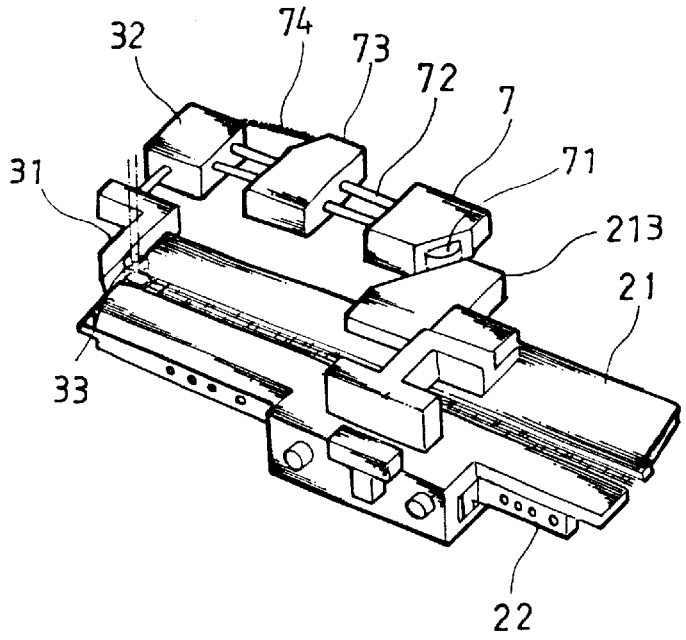
FIGS. 14A, 14B, 15A and 15B illustrate the working principle of the positioning device.
Figure 14B:
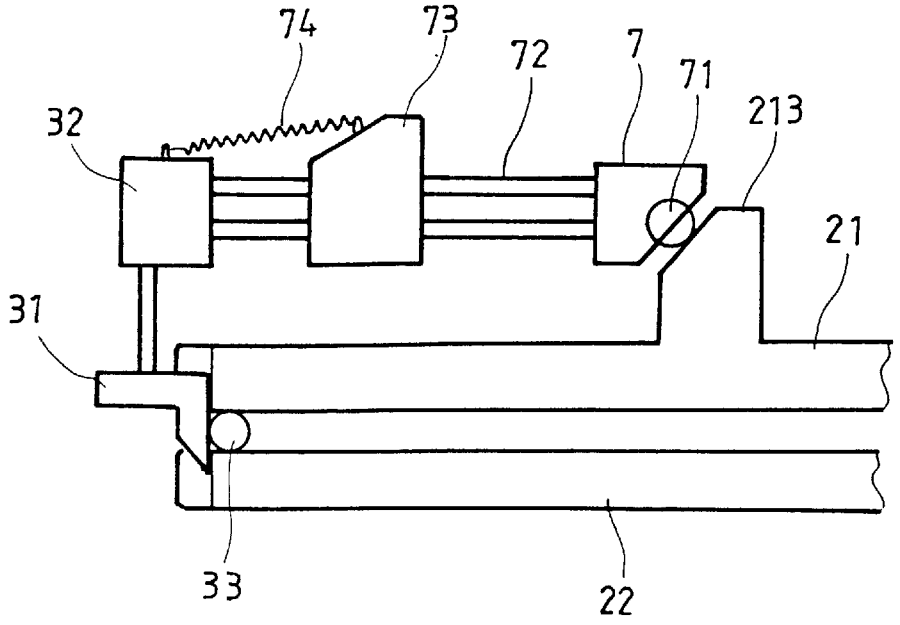
Figure 15A:
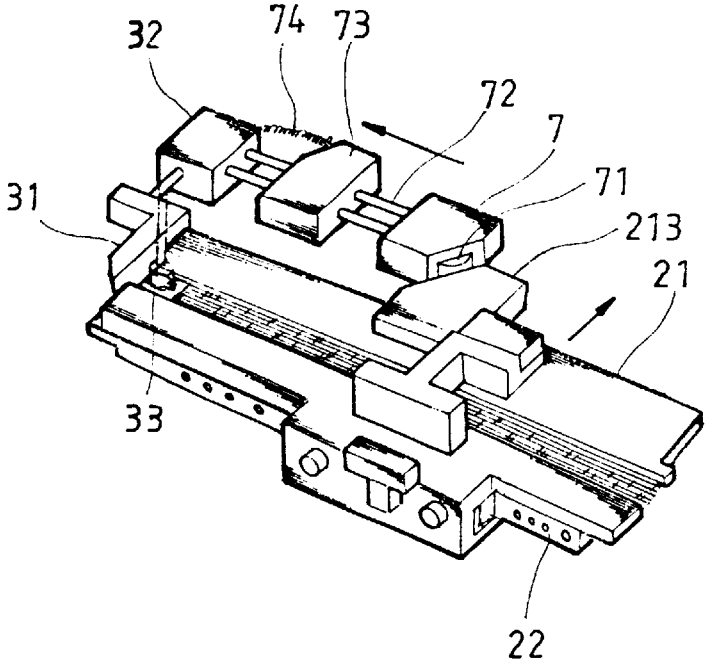
Figure 15B:
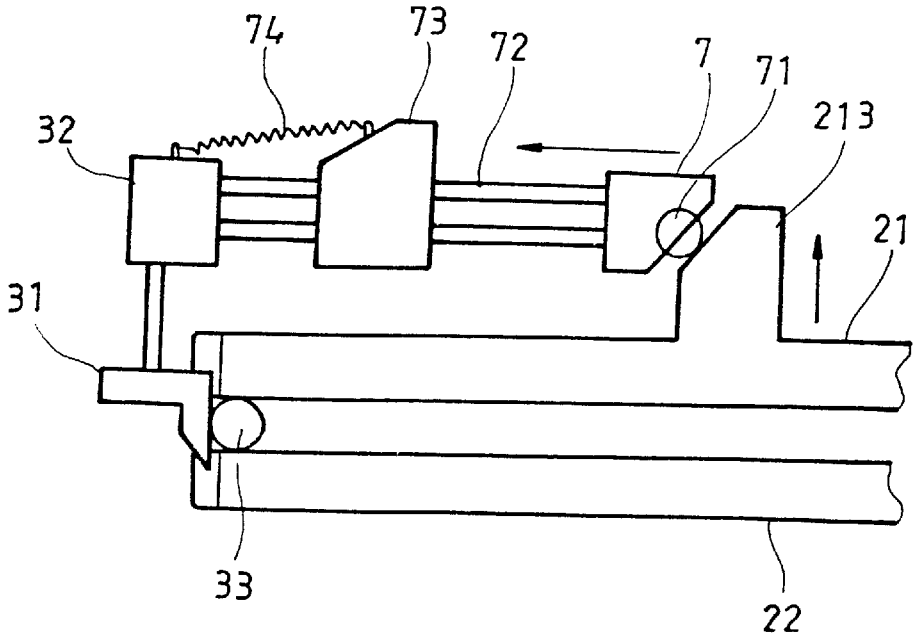
Figure 16:
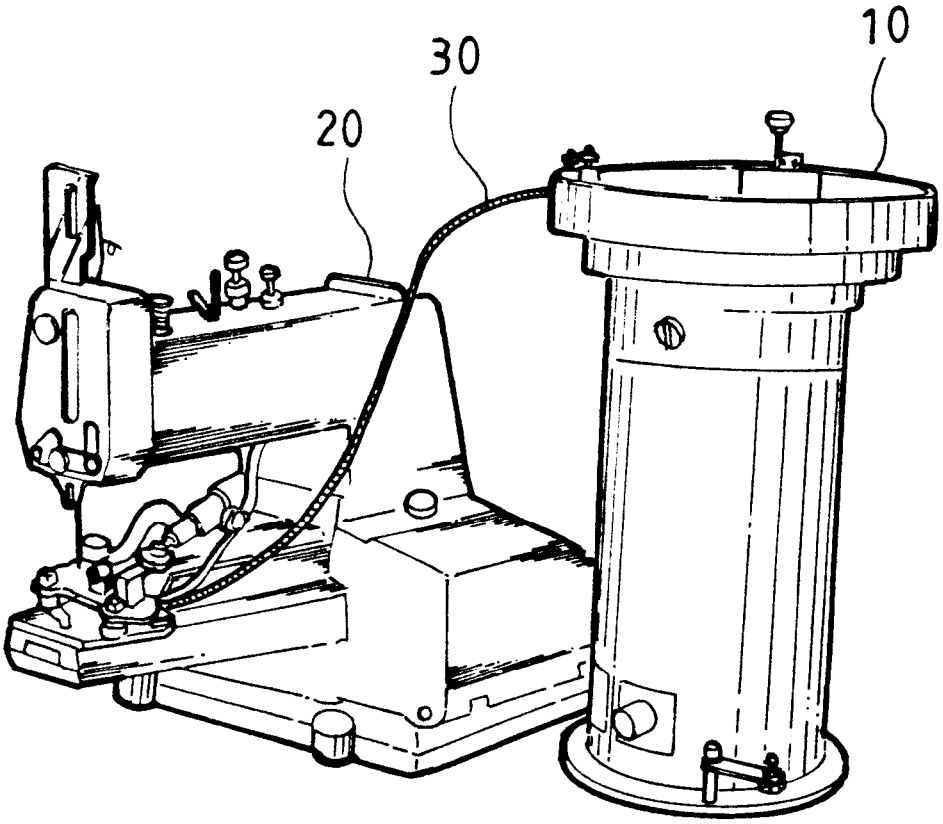
PRIOR ART FIG. 16
FIG. 16 illustrates a prior art button transmission device.
Figure 17:
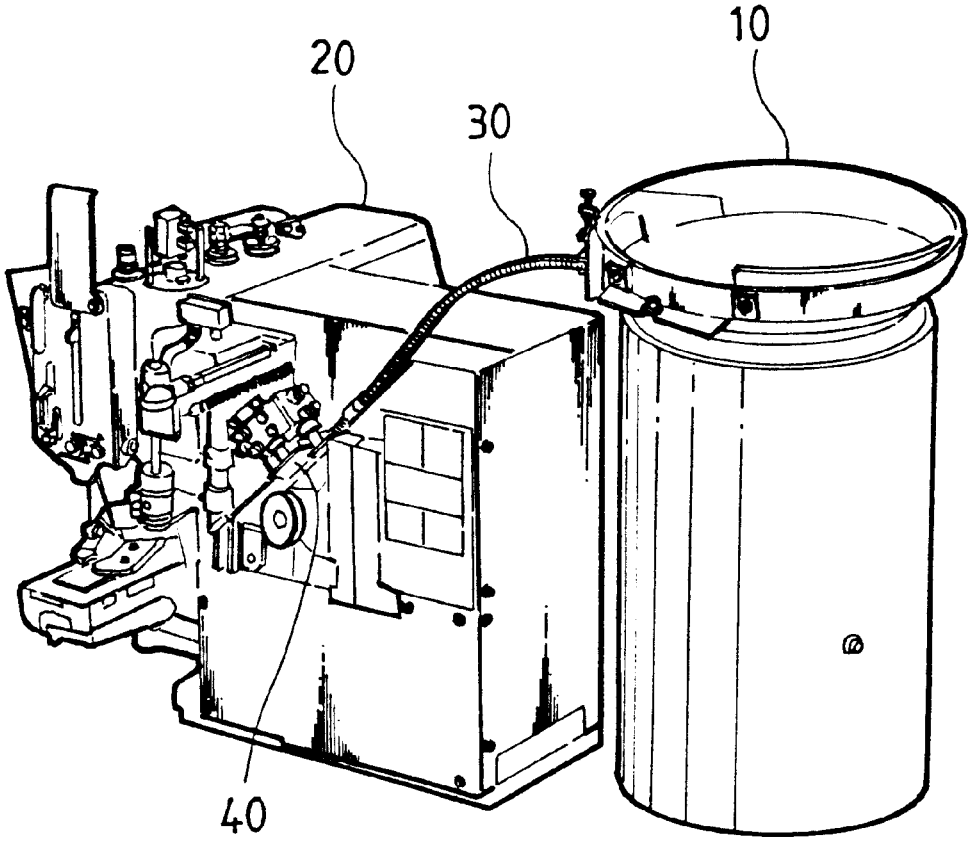
PRIOR ART FIG. 17
FIG. 17 illustrates another prior art button transmission device.

Turning now to FIGS. 9 and 10, the distance between the puller 221 and the positioner 211 is smaller than the width of the sliding plate 22 and a button 6 can be fitted between the puller 221 and the positioner 211. When desired to transmit buttons with different width and thickness, it is only necessary to turn the circular disc 2 to raise the inverted U-shaped member 28, move the puller 221 to fit a button 6 under the longer leg of the inverted U-shaped member 28, and then rotate the circular disc 2 to lower the longer leg of the inverted U-shaped member 28 on the button 6. Hence, the present invention can be used for transmitting buttons with different thickness and diameter.

Looking now at FIGS. 3, 4, 13, 14A, 14B, 15A and 15B, a strip member 230 is mounted on the intermediate portion of the conveyor belt 23 and has two sides higher than the conveyor belt 23, so that when the conveyor belt 23 is driven by a motor 8, the friction between the button 6 and the conveyor belt 23 can be reduced. Furthermore, when the button 6 is stopped but the conveyor belt 23 is still running, the conveyor belt 23 will not rub the button 6 thus preventing the conveyor belt 23 from being damaged. Referring to FIGS. 14A, 14B, 15A and 15B, the end of the conveyor belt 23 is provided with a stopper 31 which is drivingly connected with a pneumatic cylinder 32. On the sliding plate 21 there is a protuberance 213 having an inclined surface bearing a roller 71 against the push member 7. A fixed seat 73 is slidably mounted on the rods 72. When the sliding plate 21 is moved, the rods 72 and the stopper 31 will be moved therewith. A spring 74 is used for steadying the push member 7, the rods 72 and the pneumatic cylinder 32. Hence, the sliding plate 21, the sliding plate 22 and the stopper 31 will move an equal distance in three directions to adjust the space for receiving a button 6 thereby constituting the positioning device 3. By means of the round rod 33, the button 6 will accurately fall down on the oscillating arm 4 thus transmitting the button 6 to a jig 5 for fastening to a garment. When the distance between the sliding plates 21 and 22 is decreased, the spring 74 will withdraw the stopper 31 to reduce the space for receiving the button.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A button transmission device for a button-sewing machine comprising:

a conveying device including two elongated sliding plates, a seat arranged between said two sliding plates, and a conveyor belt mounted on said seat, a positioner disposed above said seat, a puller arranged on one of said sliding plates and located against said positioner, said sliding plates being provided at a bottom with two toothed racks between which is engaged a gear;

a thickness adjuster arranged above said conveying device, said thickness adjuster including a case in which is fitted a slide, said slide being slidably mounted on two vertical guide rods, a screw rod extending vertically downwardly through said case to engage with an intermediate portion of said slide and extending vertically downwardly, a circular disc to pivotally connect with an L-shaped adjusting rod, said L-shaped adjusting rod having a vertical portion provided at a lower end with a roller, a cylindrical portion integrally formed at a central portion of said circular disc and having a center hole for passage of said screw rod, said circular disc being formed with an inclined track on which is arranged said roller;

a positioning device provided with a stopper drivingly connected with a pneumatic cylinder, one said sliding plates having a protuberance having an inclined surface bearing a roller against a push member, a fixed seat slidably mounted on a pair of rods so that when one of said sliding plates is moved, said pair of rods and said stopper will be moved too thereby adjusting space for receiving a button; and a strip member mounted on an intermediate portion of said conveyor belt and having two sides higher than said conveyor belt to reduce friction between a button and said conveyor belt.

* * * * *